US005867826A

United States Patent [19]

Wilkinson

[11] Patent Number: 5,867,826

[45] **Date of Patent: *Feb. 9, 1999**

[54] ENERGY EXPENDITURE/TRAINING GARMENT

[76] Inventor: William T. Wilkinson, P.O. Box 73, Salem, N.J. 08079

[ * ] Notice: The term of this patent shall not extend beyond the expiration date of Pat. No. 5,737,773.

[21] Appl. No.: 922,256

[22] Filed: Aug. 25, 1997

[51] Int. Cl.[6] ..... A41D 1/00; A41D 13/00

[52] U.S. Cl. ..... 2/69; 2/79; 2/115; 482/105

[58] Field of Search ..... 2/69, 79, 228, 2/238, 227, 170, 108, 102, 70, 232, 231, 233; 482/105, 121, 124, 131, 74; 450/104

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,733,615 | 5/1973 | Jaffee | 2/227 X |
| 3,759,510 | 9/1973 | Jackson . | |
| 3,839,739 | 10/1974 | Engel | 2/232 |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,670,913 | 6/1987 | Morell . | |
| 4,698,847 | 10/1987 | Yoshihara . | |
| 4,910,802 | 3/1990 | Malloy . | |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz . | |
| 5,060,315 | 10/1991 | Ewing . | |
| 5,062,642 | 11/1991 | Berry . | |
| 5,109,546 | 5/1992 | Dicker . | |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker . | |
| 5,203,754 | 4/1993 | Maclean . | |
| 5,256,119 | 10/1993 | Tudor . | |
| 5,263,916 | 11/1993 | Bobich . | |
| 5,267,928 | 12/1993 | Barile . | |
| 5,282,277 | 2/1994 | Onozawa . | |
| 5,306,222 | 4/1994 | Wilkinson . | |
| 5,308,305 | 5/1994 | Romney . | |
| 5,336,139 | 8/1994 | Miller . | |
| 5,357,637 | 10/1994 | Moore . | |
| 5,367,708 | 11/1994 | Fujimoto . | |
| 5,372,565 | 12/1994 | Burdenko . | |
| 5,375,610 | 12/1994 | Lacourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker . | |
| 5,708,976 | 1/1998 | Dicker | 2/69 |
| 5,737,772 | 4/1998 | Dicker et al. | 2/69 |
| 5,737,773 | 4/1998 | Dicker et al. | 2/69 |
| 5,745,917 | 5/1998 | Dicker et al. | 2/69 |
| 5,778,452 | 7/1998 | Dicker et al. | 2/69 |

*Primary Examiner*—Gloria M. Hale
*Attorney, Agent, or Firm*—Connolly & Hutz

[57] ABSTRACT

An energy expenditure/training garment includes a suit having integral resistance panels and a base fabric covering other portions of the suit. The suit includes a body portion, arm portions and leg portions. In one practice of the invention the resistance panels and the base fabric are made of contrasting colors to provide indicating structure of the type of garment. In other practices of the invention various connecting structure is used to connect the resistance panels of the leg directly to footwear such as sneakers, roller blades or boots so that the footwear functions as anchor structure for the panels.

33 Claims, 2 Drawing Sheets

ENERGY EXPENDITURE/TRAINING GARMENT

BACKGROUND OF THE INVENTION

The present invention relates to garments which would be used during an exercise or sport or in training, such as military type training, wherein the user would also wear some specialized form of footwear. Garments for expending energy have been known which incorporate elastic resistance elements as separate cords or bands or as panels of the garment. In use of the garments when the user performs certain activities such as bending motions of the hands, legs or body, energy is expended in stretching the material and then in resisting the material returning to its original condition. In order to maximize the effectiveness of such garment the resistance material should be anchored so that it will not tend to ride up, for example, the arms or legs of the user. In my U.S. Pat. Nos. 5,186,701 and 5,306,222 I disclose aerobic resistance exercise garments wherein the resistance elements are separate cords which may be secured to various types of handwear and footwear.

U.S. Pat. Nos. 5,109,546; 5,201,074; and 5,570,462 which issued to Timothy P. Dicker disclose a different type of exercise garment which incorporates bands or panels that are anchored at the feet by the inclusion of stirrups which loop around the feet of have hand loops.

SUMMARY OF THE INVENTION

An object of this invention is to provide an energy expenditure/training garment which utilizes effective anchoring structure.

A further object of this invention is to provide such a garment which incorporates structure to clearly identify the garment.

In accordance with one embodiment of this invention the energy expenditure/training garment is a suit of one or two piece construction having a body portion with arm portions and leg portions. The suit incorporates as part of the garment itself elastic resilient panels integral with the garment. The elastic resilient panels are provided on the arm portions, body portions and leg portions. The panels themselves are connected directly to footwear so that the footwear serves as the anchor structure for the garment in the leg portions. Preferably, the footwear is in the form of sneakers or boots, such as military boots. The footwear could also be roller blades or in line skates.

In accordance with a further practice of this invention the suit is anchored to the hands by use of hand loops wherein the portion of the hand loop where the hand loop would be disposed between the thumb and forefinger would be padded to alleviate chaffing or rubbing. The padding could be in the form of an absorbent material such as terrycloth to also absorb perspiration. The invention may be practiced where absorbent material is at other portions of the suit which would be in direct contact with the user's skin.

In accordance with another practice of this invention the elastic panels and the main fabric are made of contrasting colors so as to readily identify to the user that the garment includes such elastic panels. If desired, a color scheme could be used so that different colors pertain to different types of elastic panels thereby permitting a series of garments to be used in a training program.

In accordance with yet a further practice of the invention use is made of the user's ability to feel muscle movement in stretching the resistance panels or cords and in resisting the panels or cords from returning toward their original condition. Such ability to feel muscle movement is incorporated in a training program where the feeling of the muscle movement is used as biofeedback so as to assist in modifying the training program by either adjusting the motions taken by the user or varying the level of exertion by altering the amount of resistance encountered.

THE DRAWINGS

DETAILED DESCRIPTION

The present invention is directed in one aspect to the manner of attaching the suit portion of an energy expenditure training garment to the footwear, such as sneakers, in line skates or boots. In particular, the garment would include a one or two piece suit which incorporates elastic resistance panels as integral portions of the suit. The panels are located in the arm portions, body portions and leg portions of the suit. Variations of such suits are disclosed in U.S. Pat. Nos. 5,109,546; 5,201,074; and 5,570,472, as well as pending application Ser. No. 627,426 filed Apr. 4, 1996; Ser. No. 660,098 filed Jun. 6, 1996; Ser. No. 734,736, filed Oct. 21, 1996; Ser. No. 761,290, filed Dec. 6, 1996; Ser. No. 777,453, filed Dec. 3, 1996; Ser. No. 802,972, filed Feb. 20, 1997; Ser. No. 802,973, filed Feb. 20, 1997; Ser. No. 834,887, filed Apr. 7, 1997; Ser. No. 840,917, filed Apr. 25, 1997; Ser. No. 880,715, filed Jun. 23, 1997; and Ser. No., filed July 1997, in the name of Timothy Dicker and William T. Wilkinson and entitled Energy Expenditure/Training Garment. All of the details of those patents and applications are incorporated herein by reference thereto. Such patents and applications disclose suitable materials for the base fabric of the garment and for the resistance panels. Such patents and applications also disclose possible locations and interrelationships between the base fabric and the resistance panels.

Figure 1:
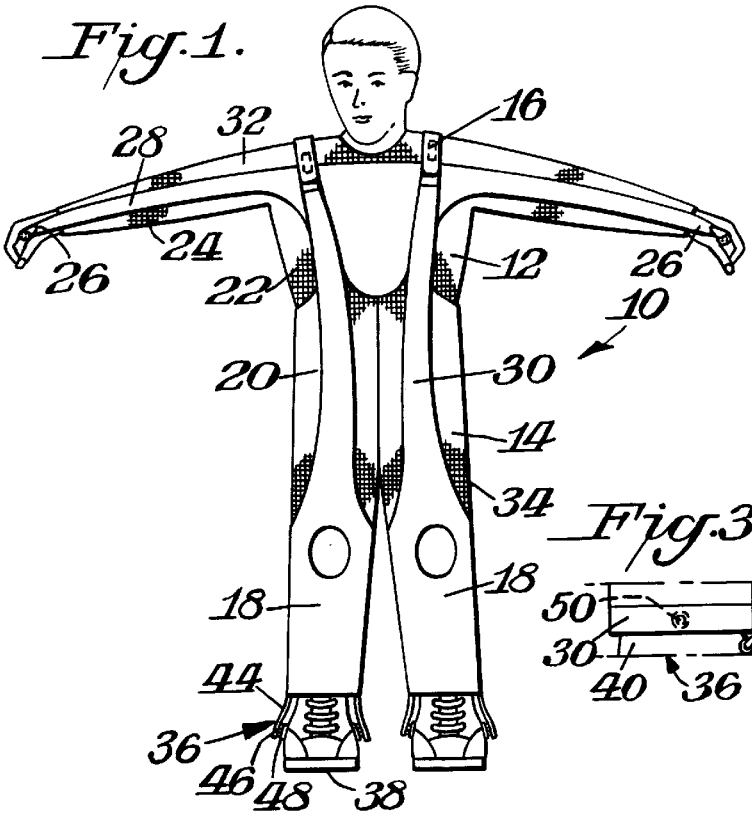
FIG. 1 is a front elevational view of an energy expenditure/training garment in accordance with this invention.

As shown in FIG. 1 an energy expenditure/training garment 10 is illustrated in the form of a suit which could be of one or two piece construction. In the embodiment illustrated in FIG. 1 the suit is of two piece construction which includes a shirt 12 which may be in the form of leotard wherein the pants 14 fits over the shirt 12. The pants 14 include a pair of suspenders 16 and leg portions 18 in addition to the body portion 20. Shirt 12 has a body portion 22 and arm portions 24 terminating in hand loops 26 which would function to anchor the resistance panels 28. Instead of anchoring by means of hand loops the end of the arm portions 24 may be compression cuffs which provide a manner of anchoring the resistance panels 28 or panels 28 may be secured to the hands by being secured to gloves, etc.

Where the suit is of two-piece construction particularly where intended for use by a female the shirt portion could be a leotard which would be worn partially below the pants portion. Where the suit is of one-piece construction and particularly where intended for use by a male or for use by the military or law enforcement persons the one-piece suit would have an elongated zipper, preferably down the front extending, for example, to at least the waist as long as the zipper extends a sufficient length to permit the suit to be readily worn and removed.

The suit preferably includes a plurality of integral resistance panels such as the panels 28 in the shirt 12 and the panels 30 in the pants 14. The panels 28 are integral with the base fabric 32 while the panels 30 are integral with the base fabric 34. The panels, however, have greater resistance characteristics than the base fabrics. In accordance with one aspect of this invention various anchoring structure is incorporated on panels 30 at the lower ends of the legs for securement to footwear as later described.

One feature of the invention is in forming the resistance panels 28,30 of contrasting color as compared to the base fabric material 32,34. The use of contrasting colors is particularly advantageous in that it functions as a manner of identifying the garment 10 as being an energy expenditure/training garment to distinguish it readily at a glance from other types of garments. In addition, the contrasting color combination could act as an indicator to distinguish one type of energy expenditure garment from another energy expenditure garment. Certain of such garments have the resistance panels located in accordance with a specific type of activity. Examples are garments used specifically for cycling, swimming, golfing, etc. Distinct color combinations could be used to represent the different type of energy expenditure garments. Further function of the contrasting colors is to indicate the level of resistance where a series of otherwise similar garments are used as part of a training program. A dark red for the resistance panels might be used where the resistance panels offer a high degree of resistance while lighter shades of red could be progressively used for lesser degrees of resistance.

The contrasting colors for the resistance panels and the base fabric could be in the form of two distinctly different colors or could be the same colors wherein different shades of color are used for the resistance panels then for the base fabric. Contrasting colors could also result by having the base fabric and the resistance panels made from materials with different light reflection characteristics which results in a contrasting color effect even where same general colors are used. Thus, essentially the same color might appear to be used for both materials but the visual effect would be of a contrasting nature by having one of the materials give greater light reflection than the other.

In accordance with a further aspect of this invention use is made of the recognition that a wearer of an energy expenditure or resistance garment would feel the user's muscle movement during use of the garment. The ability to feel muscle movement as an indicator of proper functioning of the garment is used in accordance with this invention as a biofeedback. In this regard, where such a garment is used in a training program the feeling of muscle movement could be translated as a check to determine if the proper garment and/or body movements are being used for that stage of the training. For example, during the use of a garment the wearer might recognize that the degree of resistance being encountered has lessened. This could mean that a garment having greater resistance should now be used or that there should be some change or modification in the exercise movements so as to encounter greater resistance and thereby achieve more benefits from wearing the garment. This biofeedback would then be used to cause a modification in the training with regard, for example, to the form of movement and/or the level of exertion and/or the degree of resistance encountered from the garment. This aspect of the invention could be practiced where the resistance structure in the garment is in the form of integral panels or as separate cords or bands. Reference is made to all of the aforementioned patents and applications referred to herein as showing suitable resistance structure.

Where some modification is to be made in the training program such as by changing the resistance, such change in resistance could be accomplished either by using a different garment with different resistance characteristics or by using a resistance garment which incorporates structure providing adjustability in the amount of resistance for the resistance elements.

As noted, in order to maximize the benefits of including resistance panels in the garment the resistance panels should be anchored. Where the panels are incorporated in the leg portions of the garment various types of anchoring techniques could be used. Examples are having a stirrups that goes under or around the shoe, attaching a sock/booty on the end of the pant leg as an integral component of the pant leg, having a separate sock/booty which is attached to the pant leg, utilizing a permanent or detachable compression sleeve on the bottom of the pant leg that puts pressure on the various parts such as the lower leg, ankle or foot, and where a short pants version is used the point of attachment to the various anchoring structure could be above or at or just below the knee such as by using a compression cuff on the bottom of the short pants. The various embodiments shown in FIGS. 1–12 are directed to the detachable attachment of the resistance panels on the pants legs to various types of footwear.

Figure 2:
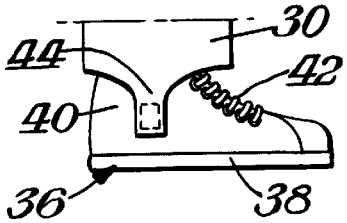
FIG. 2 is a side elevational view showing the manner of attaching the legs of the garment to sneakers.

FIGS. 1–2 further illustrate the practice of the invention wherein the garment 10 is used on footwear in the form of sneakers 36. Sneakers 36 could essentially be of any known form which would include, for example, a sole 38 having a tread on its lower surface and would include an upper portion 40 having the opening into which the foot is inserted with the sneaker then being attached in any suitable manner such as by laces 42. In accordance with the embodiment shown in FIGS. 1–2 the panel 30 includes a flap or tab extension 44 of sufficient length to overlap the upper portion 40 of the sneaker 36 in the area of the foot opening and extending partially down the upper portion 40. Tab 44 is provided with hook and loop structure (VELCRO®) 46 which engages with complementary structure 48 secured on opposite sides of the upper portion 40. In this manner, the panel 30 is securely connected to sneaker 36 so that the sneaker 36 functions as the anchoring structure for the lower end of panel 30. The use of adjustable connecting structure permits the degree of resistance from panels 30 to be appropriately adjusted.

Figure 3:
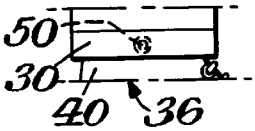
FIG. 3 is a side elevational view of a portion of an energy expenditure/training garment showing an alternative manner of attachment.

FIG. 3 illustrates a modified form of connecting structure wherein the panel 30 extends below the top edge of the upper portion 40 of the sneaker 36. Panel 30 includes a snap fastener 50 at spaced locations so as to engage a complementary snap fastening receptor permanently secured on opposite sides of top portion 40. If desired, a series of snap fasteners and/or a series of receptors could be provided to give adjustability.

One use of the combined garment shown in FIGS. 1–2 and in FIG. 3 wherein the sneaker is connected to and becomes part of the garment is as a training or exercise garment, for example, in high school or college physical education classes where a number of students or participants would each wear a garment 10 and participate in a joint exercise or training program. Such group participation could also be part of a training program for an athletic team. Prior patents relating to energy expenditure garments generally describe the garments in a context where use of the garment is intended by a single individual in accordance with that individual's own training program. The present invention, however, recognizes that such garments could be utilized for group use where there is some uniformity or customized control to the exercises being performed by the various individuals in the group. Thus, in a training program a number of individuals would wear exercise garments and could, for example, undergo the same specific exercises with the individual exercise garments either being of the same type with regard to the amount of resistance encountered or could be adjusted in accordance with the level of progress of various individuals in the group. Accordingly, the group use of exercise garments, particularly in connection with footwear intended to be used for a specific type of exercise such as running, jumping, etc. would be used to achieve general results for the entire group.

Figure 4:
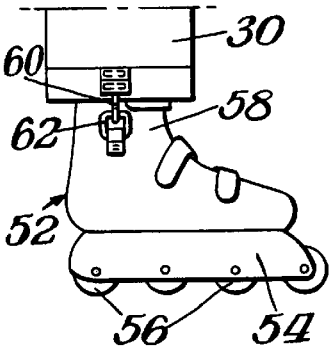
FIG. 4 is a view similar to FIG. 2 showing attachment of the suit to an in line skate.

FIG. 4 shows an alternative practice of the invention wherein the footwear is a roller blade or in line skate 52. As shown therein the skate 52 would include a lower portion 54 having the series of in line rollers 56. The skate 52 would also include an upper portion 58 which is connected to the panel 30 in any suitable manner so that the skate 52 functions as the anchoring structure for panel 30. Any suitable means of connection could be used such as shown in FIGS. 1–3. Alternatively, FIG. 4 shows the manner of connection to include a hook structure 60 extending from panel 30 and detachably connected to ring 62 secured to skate 52.

Figure 5:
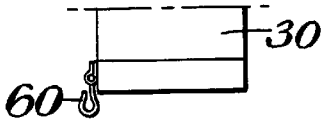
FIG. 5 is a side elevational view of the attachment structure shown in FIG. 4.
Figure 6:
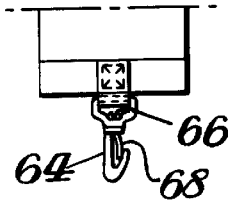
FIG. 6 is a side elevational view of a modified form of attachment structure.

FIG. 5 illustrates in side view a suitable hook structure 60. FIG. 6 illustrates an alternative hook structure 64 which has a swivel connection 66 and a spring closure 68.

Figure 7:
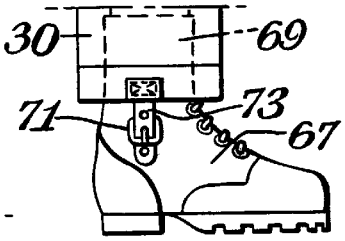
FIG. 7 is a side elevational view similar to FIGS. 2 and 4 showing attachment of a suit to a boot.

FIG. 7 illustrates yet another practice of the invention wherein the footwear 67 is a boot such as a military boot which would be worn by members of the military or by law enforcement personnel, such as police, etc. As shown in phantom, the upper portion 69 extends a greater length on the user's leg with the panel 30 thereby covering a greater amount of the upper portion 69. In the illustrated embodiment a buckle 71 is secured to upper portion 69 for engagement in a suitable hole in strap 73.

Figure 8:
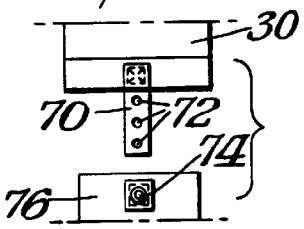
FIGS. 8–10 are side elevational views showing various manners of attachment.

FIG. 8 shows an alternative connecting structure which could be used for connecting the panels 30 with the appropriate footwear. As shown therein, a strap 70 is connected to and extends downwardly from panel 30. Strap 70 is provided with a plurality of holes 72 for selective engagement on a post 74 at the upper portion 76 of the footwear.

Figure 9:
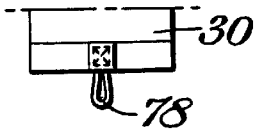

FIG. 9 illustrates a further variation wherein a loop 78 extends downwardly from panel 30 to be engaged, for example, by post 74 of the footwear shown in FIG. 8.

Figure 10:
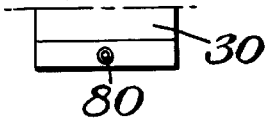

FIG. 10 illustrates yet another variation in connecting structure wherein the panel 30 includes a reinforced hole 80 for engagement with complementary structure on the footwear such as post 74.

Figure 11:
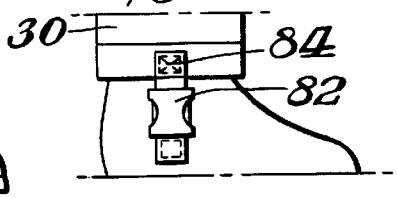

FIG. 11 illustrates yet another form of connecting structure wherein the footwear includes a snap buckle fastener 82 for engaging the strap 84 extending downwardly from panel 30.

Figure 12:
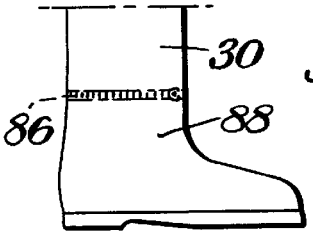
FIGS. 11–12 are side elevational views similar to FIGS. 2, 4 and 7 showing yet further manners of attachment.

In the embodiment shown in FIG. 12 the panel 30 is anchored to the footwear by a zipper 86 at the lower end of panel 30 and the upper portion 88 of the footwear.

In one practice of the invention with the use of military boots the garment 10 would be used for training purposes such as in performing calisthenics, running, etc, wherein a group of individuals would each wear the garment including the boots and perform the training exercise.

Generally, where the invention is practiced with the suit being attached to a military boot, the military boot would be black and the panel 30 could be black or some color specifically selected to complement or contrast with or blend with the color of the boot.

It is to be understood that the various types of connections shown for a particular type of footwear could be used with other types of footwear with other types of embodiments in the spirit of this invention.

Preferably, the footwear could comprise a base type of footwear such as sneaker or boot of conventional structure with the construction then being modified so as to include some connecting structure for cooperating with complementary structure on the resistance panel to secure the panel in at least one, and preferably two, locations on each item of footwear so that the footwear functions as an anchor for the lower end of the panel. The footwear could also be a strap or band having complementary locking structure for engagement with the locking structure on the pants so that when the ends of the strap or band are secured to the pants a stirrups type footwear results which would be worn around the foot. If desired, the foot with the stirrups thereon could be inserted in a sneaker or other outer footwear. In the preferred practice of the invention the fastening structure on the footwear is permanently attached to the footwear, although the invention may be practiced with detachable connecting structure on the footwear.

In the preferred practice of the invention the panel is detachably connected to the footwear so as to permit the footwear to be used independently of the suit and conversely so as to permit the suit to be used with various types of footwear or without any footwear. In such practice which omits footwear the connecting structure on the pants panels 30 could be interconnected by straps or loops to form a stirrup where the suit is used without being connected to any footwear.

Although the invention is preferably practiced where the suit is detachably secured to the footwear, the invention may also be practiced where there is a permanent attachment by any suitable structure. In such practice of the invention the suit would have to include suitable structure to permit the user to insert the user's legs through the legs of the suit and then directly into the footwear.

The invention may be practiced where the pants panel 30 terminates at the top of the upper portion of the footwear or preferably where the pants panel extends at least slightly below the top of the upper portion of the footwear. The invention, however, may also be practiced where the pants panel terminates above the upper portion of the footwear but is still connected by the suitable connecting structure such as elongated straps or flaps. The connection of the pants panel 30 to the footwear would be made in the general area of the foot opening in the upper portion of the footwear. Where multiple structure is used on the upper portion such structure should be longitudinally in line with the foot opening of the upper portion.

Figure 13:
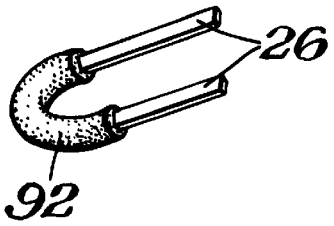
FIG. 13 is a perspective view of a portion of a hand loop in the embodiment shown in FIG. 1.

FIGS. 1–12 illustrate various manners of anchoring the resistance panels in the legs of the garment. The resistance panels 28 in the arms or sleeves of the garment should also be anchored. Any suitable type of anchoring can be used in accordance with the broad aspect of the invention such as by the use of hand loops 26 as shown in FIGS. 1 and 13 or gloves 90 shown in FIG. 14. A further anchoring structure could be compression bands. Reference is made to the aforenoted patents and applications which disclose various types of anchoring structure at the hands or wrists.

FIG. 13 illustrates a further feature of the invention which takes into account that when a hand loop is used the loop is positioned between the thumb and forefinger of the user. This results in pressure being applied at that location of the hand. A disadvantage with known structures is that the loop may cause rubbing or chaffing. FIG. 13 illustrates the incorporation of padding 92 around hand loop 26 at the area which would be between the thumb and forefinger so as to minimize chaffing and thus alleviate any discomfort that might otherwise result. Any suitable type of padding could be used such as foam material or absorbent material such as terrycloth. Such absorbent material will have the added function of absorbing perspiration between the thumb and forefinger.

Chaffing could also be avoided by forming the hand loop material of a fabric which is, for example, rolled and then has the outer edges sewn together. In this practice the seam resulting from the sewing would be located on the outer portion of the hand loop so as to be out of contact with the wearer's hand in the thumb/forefinger area. This practice could be done without added padding.

Figure 14:
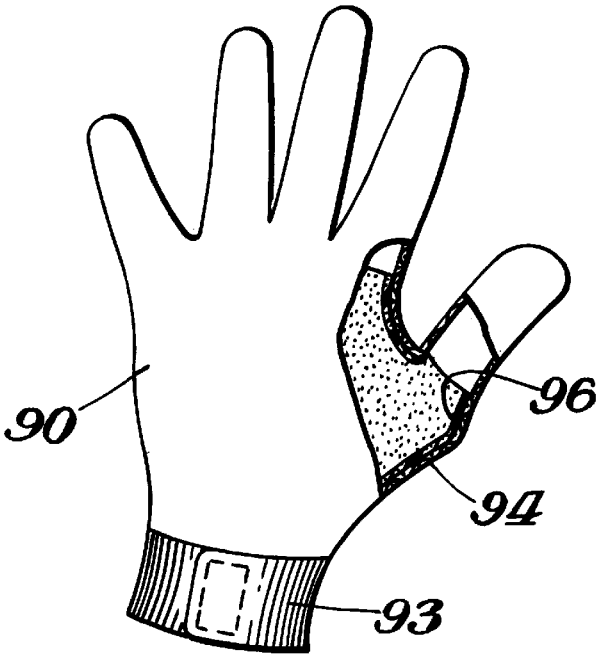
FIG. 14 is an elevation view partly broken away and in section of a glove that may be used for anchoring the arm resistance elements in accordance with this invention.

FIG. 14 shows a further form of hand anchoring structure which is illustrated as being a glove 90. Glove 90 includes a cuff 93 which would have any suitable structure for attachment to the resistance panel 28. Such structure could be of the various types illustrated and described for the footwear.

FIG. 14 illustrates a further feature of the invention wherein the glove 90 includes an outer layer 94 of any suitable material. An inner liner 96 is also provided made of absorbent material such as terrycloth which would be located in areas likely to encounter a high degree of perspiration such as in palm portion. As a safeguard the entire inner surface of the outer material 94 could be lined. The invention could also be practiced by providing such absorbent lining at any and all locations of the garment likely to be on portions of the body having sweat or perspiration whether the location be at the resistance panels or at the base fabric. Preferably, such absorbent lining should be provided where the portions of the garment are in direct contact with the user's skin.

It is to be understood that various features described with certain embodiments may be used with other embodiments. Thus, for example, the aspect of the invention which includes providing an absorbent lining on portions of the suit to absorb sweat or perspiration could be used with suits or garments wherein the resistance elements are separate cords or bands as well as integral panels.

What is claimed is:

1. An energy expenditure/training garment comprising a suit having a body portion and elongated outwardly extending arms and downwardly extending legs, said suit being made of a base fabric and panels integral with said base fabric, said base fabric and said panels having different resistance and elasticity characteristics with said panels requiring a greater force to stretch said panels and to resist said panels returning toward their original condition than would be required for said base fabric, said panels being located in said body portion and said legs, said panels in said legs terminating at the lower end of each of said legs and coupling structure on each of said panels at said lower end of its said leg for engagement with complementary coupling structure on footwear for connecting each leg to a respective one of the footwear whereby the footwear may comprise anchoring structure for said panels on said legs.

2. The garment of claim 1 in combination with a pair of articles of footwear and each of said articles of footwear having said complementary coupling structure.

3. The garment of claim 2 wherein said complementary coupling structure is located on opposite sides of each of said footwear, and said coupling structure being detachably connected to said complementary coupling structure.

4. The garment of claim 3 wherein said coupling structure is adjustable.

5. The garment of claim 4 wherein said footwear includes an upper portion having a foot insertion opening, said complementary coupling structure being located at said upper portion in the general area of said foot insertion opening.

6. The garment of claim 5 wherein said panel extends below and overlaps at least a portion of said upper portion of said footwear.

7. The garment of claim 5 wherein said footwear is sneakers.

8. The garment of claim 5 wherein said footwear is roller blades.

9. The garment of claim 5 wherein said footwear is boots.

10. The garment of claim 3 wherein said footwear comprises a band which forms stirrups when mounted to said leg.

11. The garment of claim 1 wherein said panels in said arms are anchored by hand loops, and said hand loops including structure to minimize chaffing.

12. The garment of claim 11 wherein said hand loops are formed by band material sewn together to form a seam and said seam being located on the outer edge of said hand loops to comprise said structure to minimize chaffing.

13. The garment of claim 11 wherein said structure to minimize chaffing comprises padding.

14. The garment of claim 1 including an absorbent lining on the inner surface of at least portions of said garment to absorb perspiration resulting from the use of said garment.

15. The garment of claim 1 wherein said base fabric and said panels are made of contrasting colors.

16. The garment of claim 1 wherein said suit is a two-piece suit having a shirt portion in the form of leotards and a pants portion.

17. The garment of claim 1 wherein said suit is a one-piece suit having an elongated longitudinal zipper to facilitate the putting on and removing of said suit.

18. An energy expenditure garment comprising a suit having a body portion with a pair of elongated outwardly extending arms and a pair of downwardly extending legs, said suit being made of a base fabric having integral panels, said panels being located in said body portion and in said arms and in said legs, said panels being resistance panels having resistance and elasticity characteristics which require a greater force to stretch said panels and to resist said panels returning toward their original condition than the force required for said base fabric, and said panels and said base fabric being made of contrasting colors to visually distinguish said panels from said base fabric.

19. The garment of claim 18 wherein said contrasting colors are the same colors and of different shades.

20. The garment of claim 18 wherein said contrasting colors result from the material of said base fabric and the material of said panels having different light reflection characteristics.

21. The garment of claim 18 wherein said contrasting colors are separate colors.

22. The garment of claim 18 in combination with a plurality of garments said garments having resistance panels of different resistance characteristics and the contrasting color combinations of said garments differing from each other.

23. An energy expenditure garment comprising a suit having a body portion with a pair of elongated outwardly extending arms and a pair of downwardly extending legs, said suit being made of a base fabric and elongated resistance elements, said elongated resistance elements being located in said body portion and in said arms and in said legs, said elongated resistance elements having resistance and elasticity characteristics which require a greater force to stretch said resistance elements and to resist said resistance elements returning toward their original condition than the force required for said base fabric, and an absorbent lining on the inner surface of at least a portion of said garment to absorb perspiration created by use of said garment.

24. The garment of claim 23 wherein said resistance elements are secured to hand loops, and said lining comprising padding on said hand loops.

25. The garment of claim 23 wherein said resistance elements are secured to gloves, and said lining being on the palm portions of said gloves.

26. An energy expenditure garment comprising a suit having a body portion with a pair of elongated outwardly extending arms and a pair of downwardly extending legs, said suit being made of a base fabric and elongated resistance elements, said elongated resistance elements being located in said body portion and in said arms and in said legs, said elongated resistance elements having resistance and elasticity characteristics which require a greater force to stretch said resistance elements and to resist said resistance elements returning toward their original condition than the force required for said base fabric, said elongated resistance elements located in said arms being anchored to the hands of the user by hand loops for being positioned between the thumb and forefinger on the hand of the user, and said hand loop including structure to minimize chaffing of the thumb/forefinger.

27. The garment of claim 26 wherein said hand loops are formed by band material sewn together to form a seam and said seam being located on the outer edge of said hand loops to comprise said structure to minimize chaffing.

28. The garment of claim 26 wherein said structure to minimize chaffing comprises padding.

29. A method of training comprising providing a plurality of energy expenditure garments for a group of individuals with each of the garments being in the form of a suit having a body portion and arms and legs and with each of the garments being made from a base fabric and from elongated resistance elements located on the body portion and on the arms and on the legs and with the resistance elements having elasticity characteristics which require a greater force the stretch the resistance elements and to resist the resistance elements from returning toward their original condition than the force required for the base fabric, each of the individuals in the group placing an article of footwear on the individuals feet, each of the individuals of the group placing an energy expenditure garment on the individual, anchoring the resistance elements in the legs of the garment by attaching each resistance elements in each leg to the article of footwear, and the individuals in the group performing an exercise while wearing the suit and footwear.

30. The method of claim 29 wherein the footwear is sneakers and the exercise includes a running exercise.

31. The method of claim 29 wherein the footwear is military boots and the exercise is a running or calisthenics exercise.

32. The method of claim 29 including detachably securing each of the resistance elements on the legs to opposite sides of each article of footwear.

33. The method of training comprising providing an energy expenditure garment in the form of a suit having a body portion and arms and legs and with the garment being made from a base fabric and from elongated resistance elements located on the body portion and on the arms and on the legs and with the resistance elements having resistance characteristics which require a greater force to stretch the resistance elements and to resist the resistance elements from returning toward their original condition than the force required for the base fabric, the user wearing the energy expenditure garment, the user performing exercises which involve movements of at least one of the body portion and arms and legs so that the user feels muscle movement as a result of the elasticity of the resistance elements so that the feeling of muscle movement could be utilized as biofeedback, and adjusting the form of movement or level of exertion of the user or changing the level of resistance as a result of the biofeedback.

* * * * *